US007802737B2

(12) United States Patent
Rayner

(10) Patent No.: US 7,802,737 B2
(45) Date of Patent: Sep. 28, 2010

(54) VEHICLE MOUNTED, DIGITAL POSITIONING SPRAY SYSTEM

(76) Inventor: Richard D Rayner, 9390 Elder Creek Rd., Sacramento, CA (US) 95829

( * ) Notice: Subject to any disclaimer, the term of this patent is extended or adjusted under 35 U.S.C. 154(b) by 142 days.

(21) Appl. No.: 12/321,085

(22) Filed: Jan. 16, 2009

(65) Prior Publication Data

US 2010/0116904 A1 May 13, 2010

Related U.S. Application Data

(60) Provisional application No. 61/199,057, filed on Nov. 13, 2008.

(51) Int. Cl.

| | |
|---|---|
| ***E01C 19/17*** | (2006.01) |
| ***E01C 19/16*** | (2006.01) |
| ***G05D 7/00*** | (2006.01) |
| *B05B 1/20* | (2006.01) |

(52) U.S. Cl. ..... 239/172; 239/67; 239/159; 700/283

(58) Field of Classification Search ..... 239/67–69, 239/146, 155–157, 159–170, 172; 700/282, 700/283

See application file for complete search history.

(56) References Cited

U.S. PATENT DOCUMENTS

| | | | | |
|---|---|---|---|---|
| 4,817,870 | A * | 4/1989 | Dalton | 239/157 |
| 5,911,362 | A * | 6/1999 | Wood et al. | 239/1 |
| 7,438,764 | B1 * | 10/2008 | Hill | 118/313 |
| 2007/0138315 | A1 * | 6/2007 | Earle et al. | 239/146 |

* cited by examiner

*Primary Examiner*—Darren W Gorman

(57) ABSTRACT

The object of the present invention is to provide a high volume, low cost, sealant spray control system for the asphalt industry, accomplished particularly through a self contained vehicle mounted spray system utilizing a digital positioning receiver consisting of a global positioning system (GPS) or horn radar for vehicle speed sensing and a motor RPM sensor and a program logic CAN micro controller for adjusting output flow of a material pump to achieve a target application spray rate of a spray bar.

1 Claim, 1 Drawing Sheet

VEHICLE MOUNTED, DIGITAL POSITIONING SPRAY SYSTEM

CROSS REFERENCE TO RELATED APPLICATION

This application claims the benefits of my earlier filed provisional application U.S. 61/199,057 filed Nov. 13, 2008.

BACKGROUND OF THE INVENTION

1. Field of the Invention

The present invention relates generally to a spray flow control system, and in particular to asphalt sealant material with vehicle mounted spraying equipment and dedicated prime mover, and in more particularly to a speed sensing digital positioning system such as a global positioning system (GPS) or horn radar, and motor RPM sensing for a pump responsive flow control system.

2. Description of the Related Art

A vehicle mounted spray control system, having means of maintaining a correct spray application rate through vehicle speed and product pressure sensing is a known and commonly utilized system. Such a system will generally include a material tank, a pump for conveying fluid under pressure from the material tank to a spray bar, a speed sensor to calculate speed the of the vehicle, a pressure sensor near the spray head, and a programmed processor to calculate and adjust the pump output to achieve the target application spray rate, using the inputs of the speed and pressure sensors.

However, a disadvantage with many vehicle-mounted spray systems relates to the vehicle mounting capabilities of the spray system. The past spray systems are not exclusive to a dedicated prime mover for the spray system. Generally the material pump is connected to the vehicle drive shaft with the power taken off the vehicle engine. Having a dedicated prime mover for the spray system, not having to physically integrate the spray system directly into the provided vehicle, provides simple mounting capabilities. Means of speed sensing is also generally integrated into the vehicle and is commonly accomplished at the wheel of the vehicle.

Digital positioning, such as GPS and horn radar, is proven to be a reliable technology. The present invention integrates a digital positioning receiver as means for speed sensing, which provides wireless speed sensing capabilities. A digital positioning receiver eliminates the steps of sizing specific wheel diameters and physically integrating the spray system into the vehicle. The combination of a digital positioning receiver for speed sensing and a dedicated prime mover provides a versatile spray unit with unproblematic mounting capabilities.

In addition to the digital positioning wireless speed sensing, the present invention utilizes a wireless remote control of spray system. Generally on/off control of the spray system takes place at the operator control panel where the CAN micro processor and CAN digital display are located. A wireless remote control allows the operator to detach themselves from the spray unit, giving them the opportunity to physically see the flow of the product, check the consistency of the application, and to ultimately have an additional source of control of the spray system.

In relation to regulating product flow, it is also generally the case to have a pressure sensor near the spray head to be used as an input at the processor to calculate and adjust the output flow of the pump. Because of the inconsistency in asphalt sealant material, the present invention introduces new means of controlling the output flow of the pump. Rather than using pressure sensing as an input to calculate output flow of the pump, a RPM sensor can sense the rotation of the hydraulic motor which drives the pump. Given that 1 RPM at the motor equals X amount of product flow, the information from the RPM sensor can be used as an input at the processor to calculate and adjust the flow of product to the spray bar proportionate to the speed of the vehicle adjusted to the operator established spray percentage.

Past spray systems are primarily but not exclusively intended for asphalt sealant spray applications. The asphalt industry has yet to be introduced to high volume, cost efficient means of asphalt sealant application. A large product tank and simple vehicle mounting capabilities eliminates the need for a custom made, large volume asphalt sealant spray vehicle. The public can simply mount the digital positioning spray unit on a variety of truck and trailer beds.

SUMMARY OF THE INVENTION

The object of the present invention is to provide a high volume, low cost, sealant spray control system for the asphalt industry, accomplished particularly through a vehicle mounted spray system utilizing a digital positioning receiver, RPM sensor and a program logic CAN micro controller as means for adjusting output flow of a material pump to achieve a target application spray rate.

According to one broad aspect of the invention, there is a provided spray control device for use with a vehicle mountable spraying apparatus having a dedicated prime mover for the spray system, a wireless remote to control the spray system in addition to redundant analog controls, a large volume asphalt sealant material tank, a pump for conveying asphalt sealant from the material tank to a spray bar, a hydraulic operator for spray valve open/close, a digital positioning receiver for means of sensing vehicle speed, an RPM sensor at the product pump's drive motor as means for calculating product flow, a proportional hydraulic valve as means for adjusting material pump, a CAN digital display for means of selecting and adjusting operating conditions as well as diagnostics and a programmed CAN micro controller to calculate and adjust the output flow of the material pump using the digital positioning speed reading and RPM sensor reading as inputs to accomplish the target output flow of the sealant material.

DETAILED DESCRIPTION OF PREFERRED EMBODIMENT

Figure 1:
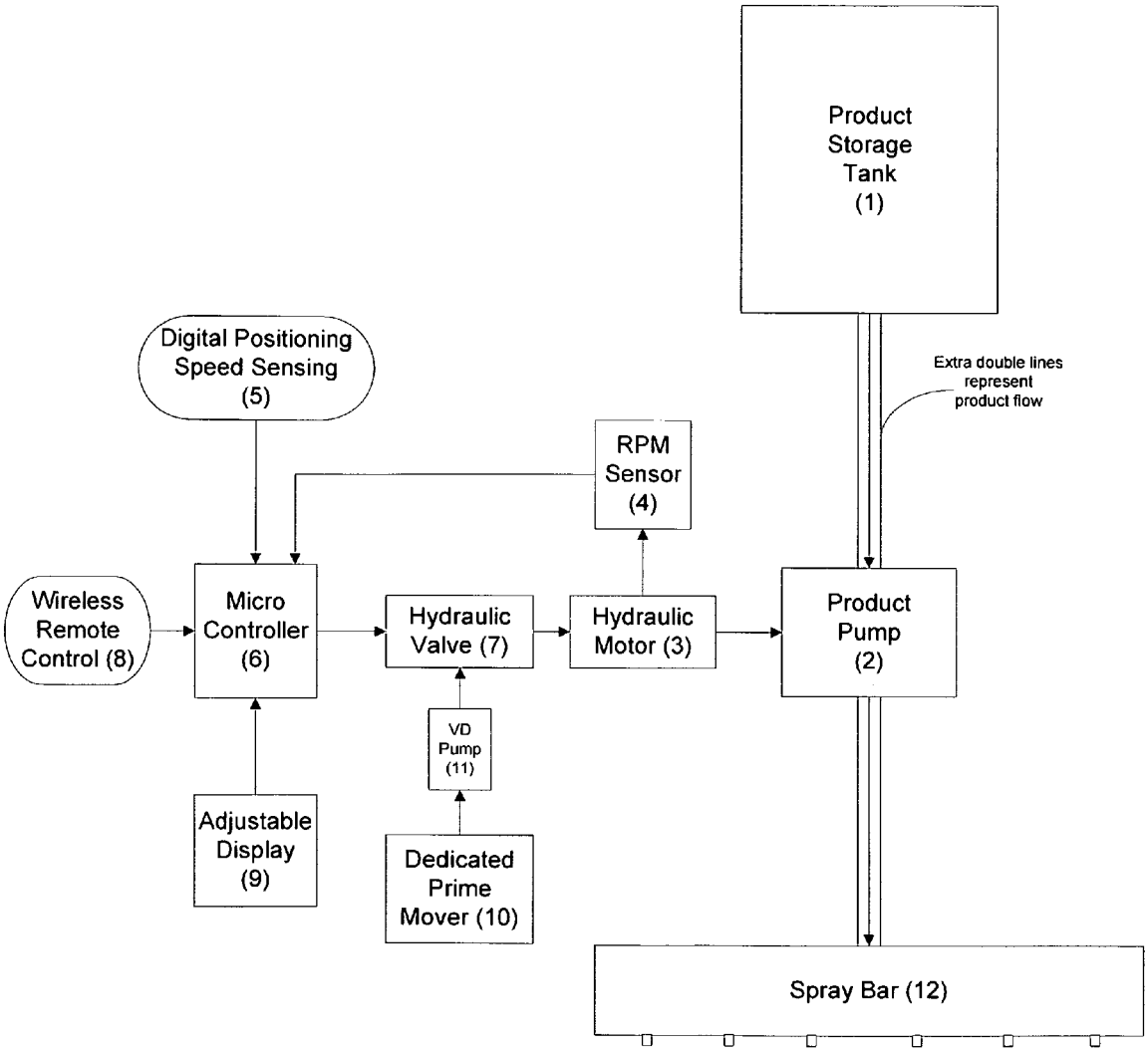
FIG. 1 is a schematic block diagram showing the process of the system and components.

The present invention is a self contained system to be mounted on the rear of a truck or trailer bed. FIG. 1 diagrams the process of the spray mount system. The primary object of this system is to meet a target spray application rate for the application of asphalt sealant material. This process starts by conveying asphalt sealant material from a product storage tank (1), by means of a hydraulic pump (2), to a spray apparatus (12). This material flow is regulated to meet a target spray application rate, and is responsive to inputs from a digital positioning speed sensor (5) and from the product pump's RPM sensor (4).

The digital positioning sensor (5) and RPM sensor (4) inputs are fed into a micro controller (6) where the information is used within a custom software program to provide a measured output of product to the spray bar (12), and is adjusted proportionally to the speed of the vehicle. The micro controller (6) uses a base or minimum signal to the hydraulic proportional valve (7). This valve adjusts the flow of hydraulic fluid to the product pump's drive motor (3). The signal to the valve has been adjusted to include the motor's stall factor. Extensive testing was required to find this range. Where past inventions have used pressure sensing to compute output flow, eliminating the pressure sensor requirement for asphalt sealant material is critical, based on the nature of the material. This system has accomplished just that through the use of an RPM sensor.

The product pump (2) is a fixed displacement pump where 1 rpm=(X) displacement. The product needs a minimum system pressure and volume to provide an acceptable spray pattern.

Using the adjustable display (9) the user can adjust the desired pump volume. This adjustment either raises or lowers the top end of the ramp that the micro controller (6) uses to adjust the product pump in ratio to the digital positioning input. Because of the inconsistency of asphalt sealant material, the user can only compute this desired pump volume through method of trial and error of the spray system.

In addition, this system has a remote control receiver and transmitter (8) that allows for operation either by the driver of the vehicle or another person on the jobsite that is within range (300 yards) of the receiver unit.

This system is completely self contained and was designed for easy installation requiring no wiring, plumbing or outside power. The dedication prime mover (10) and variable displacement pump (11) provides for a self sufficient system.

The invention claimed is:

1. A self-contained vehicle mounted spray system, comprising:

a spray material storage tank;

a spray apparatus;

a spray material pump located between said storage tank and said spray apparatus;

a hydraulic motor for driving said spray material pump;

a dedicated prime mover for the spray system;

an RPM sensor for sensing rotation of said hydraulic motor;

a digital positioning system comprising one of a global positioning system and a horn radar for wirelessly sensing a speed of the vehicle to which the spray system is mounted; and a micro controller;

wherein said micro controller receives input information from said RPM sensor to determine an output flow of said spray material;

wherein said micro controller receives input information from said digital positioning system regarding the speed of the vehicle; and wherein said micro controller proportionally adjusts a spray material flow to said spray apparatus based on the input information from said RPM sensor and said digital positioning system in order to meet a predetermined target spray application rate.

* * * * *